US007753015B2

(12) United States Patent
Seethaler et al.

(10) Patent No.: US 7,753,015 B2
(45) Date of Patent: Jul. 13, 2010

(54) DEVICE AND METHOD FOR CONTROLLING THE LIFT OF AN OUTLET GAS EXCHANGE CHARGE CYCLE VALVE OF AN INTERNAL COMBUSTION ENGINE

(75) Inventors: Rudolf Seethaler, Munich (DE); Martin Lamprecht, Muehldorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 475 days.

(21) Appl. No.: 11/798,163

(22) Filed: May 10, 2007

(65) Prior Publication Data

US 2007/0209620 A1 Sep. 13, 2007

Related U.S. Application Data

(63) Continuation of application No. PCT/EP2005/011246, filed on Oct. 19, 2005.

(30) Foreign Application Priority Data

Nov. 12, 2004 (DE) ..... 10 2004 054 775

(51) Int. Cl.
*F01L 1/34* (2006.01)

(52) U.S. Cl. ..... 123/90.15; 123/90.16

(58) Field of Classification Search ..... 123/90.15, 123/90.16

See application file for complete search history.

(56) References Cited

U.S. PATENT DOCUMENTS 5,598,814 A 2/1997 Schroeder et al.
5,873,335 A 2/1999 Wright et al.
7,055,475 B2 6/2006 Denteler et al.
7,111,598 B2 9/2006 Gaubatz et al.
2006/0016408 A1 1/2006 Gaubatz et al.

FOREIGN PATENT DOCUMENTS

DE 101 40 461 A1 2/2003
DE 102 62 991 A1 5/2004

OTHER PUBLICATIONS

International Search Report dated Feb. 22, 2006 with an English translation of the pertinent portions (Four (4) pages).
German Examination Report dated Aug. 9, 2005 with an English translation of the pertinent portions (Ten (10) pages).

*Primary Examiner*—Zelalem Eshete
(74) *Attorney, Agent, or Firm*—Crowell & Moring LLP

(57) ABSTRACT

A device and a method for regulating the lift characteristic of an exhaust charge cycle valve of an internal combustion engine. The device comprises a controllable electric motor having an actuator element for actuation of the exhaust charge cycle valve, a regulating device for controlling the electric motor and two energy storage means acting in opposite drive directions on the exhaust charge cycle valve. The regulating device controls the electric motor according to a stored setpoint path, on the basis of which the exhaust charge cycle valve is transferred between a first end position and a second end position by swiveling the rotor of the electric motor back and forth. At least two different setpoint paths may be provided for regulating the speed of the rotor of the electric motor, whereby a lower kinetic energy is transferred to the exhaust charge cycle valve in regulation on the basis of the one setpoint path during the valve opening process than in regulation on the basis of the other setpoint path.

4 Claims, 2 Drawing Sheets

Rotor Angle
[Degree]

VÖ
VS
$E_{kin}$
t [sec]
Angular Velocity
of the Rotor Type
[rpm]
$\Delta t_{accelerated}$
SB2

SB1
t [sek]

DEVICE AND METHOD FOR CONTROLLING THE LIFT OF AN OUTLET GAS EXCHANGE CHARGE CYCLE VALVE OF AN INTERNAL COMBUSTION ENGINE

This application is a Continuation of PCT/EP2005/011246, filed Oct. 19, 2005, and claims the priority of DE 10 2004 054 775.0, filed Nov. 12, 2004, the disclosures of which are expressly incorporated by reference herein.

BACKGROUND AND SUMMARY OF THE INVENTION

The present invention relates to a device and a method for regulating the lift characteristic of an exhaust charge cycle valve of an internal combustion engine.

With traditional internal combustion engines, the camshaft is driven mechanically by the crankshaft via a control chain or a control belt. To increase engine power and reduce fuel consumption, controlling the valves of the individual cylinders individually offers enormous advantages. This is possible by means of a so-called fully variable valve drive (variable control times and variable valve lift), e.g., a so-call electromagnetic valve drive.

In a fully variable valve drive, one "actuator unit" is allocated to each valve and/or each "valve group" of a cylinder. Different basic types of actuator units are currently being researched.

With one basic type (so-called lift actuators), an opening magnet and a closing magnet are allocated to one valve or one valve group. The valves may be displaced axially, i.e., opened and/or closed, by applying electric power to the magnets.

With another basic type (so-called rotary actuator), a control shaft with a cam is provided, the control shaft being pivotable back and forth by an electric motor.

Furthermore, DE 101 40 461 A1 describes a rotary actuator device for controlling the lift of a charge cycle valve. The lift is controlled here by an electric motor that is itself controlled using characteristics maps and has a shaft with a control cam that is connected to it in a rotationally fixed manner and is arranged on its rotor. During operation of the internal combustion engine, the motor swivels, i.e., swings back and forth, and the control cam periodically forces the charge cycle valve into its open position via a roller lever. The charge cycle valve is closed by the spring force of a valve spring. An additional spring is mounted on the shaft, so that the electric motor does not have to overcome the total spring force of the valve spring in opening the charge cycle valve. The forces of the valve spring and the additional spring are such that in periodic operation of the rotary actuator device, the kinetic energy is stored either in the valve spring or in the additional spring according to the position of the charge cycle valve. As a result of this measure, the power demand in operation of the rotary actuator device is reduced. The high power demand at low rotational speeds is a disadvantage of the rotary actuator device described here.

A similar device is described in U.S. Pat. No. 5,873,335 A, where a control cam of a conventional design driven by an electric motor cooperates first with the plate valve spring-loaded by a closing spring and at the other end is connected to a spring-loaded valve lifter via an opening spring arranged orthogonally to the plate valve.

A refinement of the rotary actuator device according to DE 101 40 461 A1 is described in DE 102 52 991 A1. The existing rotary actuator device is expanded here by a second actuator element (second control cam) in the opposite direction of rotation with a lower lift in comparison with the main cam.

This second actuating element does not open the valve completely and is used only for small lifts in the range of low engine rotational speeds. At low rotational speeds of the internal combustion engine, the rotary actuator devices receives electric power such that the shaft swivels only in the direction of the second actuating element, whereas at high rotational speeds it is swiveled exclusively in the direction of the first actuating element. Due to the low lift, the rotary actuator device advantageously consumes less electric power at low rotational speeds.

The object of this invention is to create a device for regulating the lift characteristic of an exhaust charge cycle valve that will ensure an improvement with regard to electric power consumption by an actuator device. In particular, the subject of the invention should also ensure that the opening process of the exhaust valve will take place to the desired extent in any operating state. According to this invention, at least two setpoint paths are provided for regulating the speed of the rotor of an electric motor driving an exhaust charge cycle valve. The setpoint paths differ in that they create different amounts of kinetic energy during the valve opening process because of their design and the acceleration of the rotor associated with it and transfer this kinetic energy to the exhaust charge cycle valve via the actuator element connected to the rotor.

Thus, at least one first setpoint path is provided for generating and transferring a lower kinetic energy, whereby the setpoint path is used, for example, when a lower gas backpressure prevails in the combustion chamber due to a lower prevailing load and/or load demand (load within a predetermined load range of a lower load). Furthermore, at least one second setpoint path is provided, generating and transferring an increased kinetic energy in comparison with the kinetic energy of the first setpoint path. This is used when opening of the exhaust charge cycle valve can no longer be ensured reliably because of the higher gas backpressure in the combustion chamber affecting control of the rotor on the basis of the first setpoint path in the case of a higher prevailing load of load demand (for a prevailing load within a predetermined load range of a higher load) because the electric motor cannot supply enough power. In this case, the extra power required by the electric motor is compensated by generating an additional kinetic energy component. The kinetic energy component is generated by increasing the angular velocity of the rotor on the basis of a second setpoint path—at least in the displacement phase up to the crown point of the lift characteristic of the exhaust charge cycle valve (in particular, a predetermined period of time before the start of the valve movement, i.e., during the so-called free-running phase of the actuator element)—during the opening process in comparison with the angular velocity of the rotor (in the same displacement phase and/or in the same period of time) in the case of regulation according to the first setpoint path. To do so, in the case of the second setpoint path, the velocity specification for the rotor is increased in comparison with the velocity specification according to the first setpoint path, either from the beginning of the displacement characteristic (of the rotor) (and thus a defined period of time before the start of the actual valve movement) or from a predetermined point in time or a certain displacement path (of the rotor) (likewise a defined period of time before the start of the actual valve movement) such that in the free-running phase of the rotor, a greater kinetic energy is created in comparison with the first setpoint path.

Traditional rotary actuator devices having an electric motor as the drive unit for charge cycle valves generally compensate for interfering forces that occur at the point in time when they occur. If interfering forces are to be compensated in the form of gas backpressures, then electric motors of a higher power are generally required. Through the object of the present invention, electric motors of a reduced power (and thus energy consumption) and design size may be used in comparison with the prior art.

The present invention is preferably used in rotary actuator systems having an electric cam drive in which the cam drive driven by the rotor of the electric motor and driving the exhaust charge cycle valve has a free-running section. The free-running section ensures that the rotor, starting from the closed position of the exhaust charge cycle valve, in which the rotor acts with the smallest lift on the exhaust charge cycle valve—in particular the zero lift determined by the cam base circle—travels a defined startup distance segment and/or free-running segment on the cam base circle. The cam actuator element can be accelerated by the electric motor with the least energy input over the entire distance of the startup path section, thereby generating kinetic energy for transfer to the exhaust charge cycle valve.

Other objects, advantages and novel features of the present invention will become apparent from the following detailed description of the invention when considered in conjunction with the accompanying drawings.

DETAILED DESCRIPTION

Figure 1:
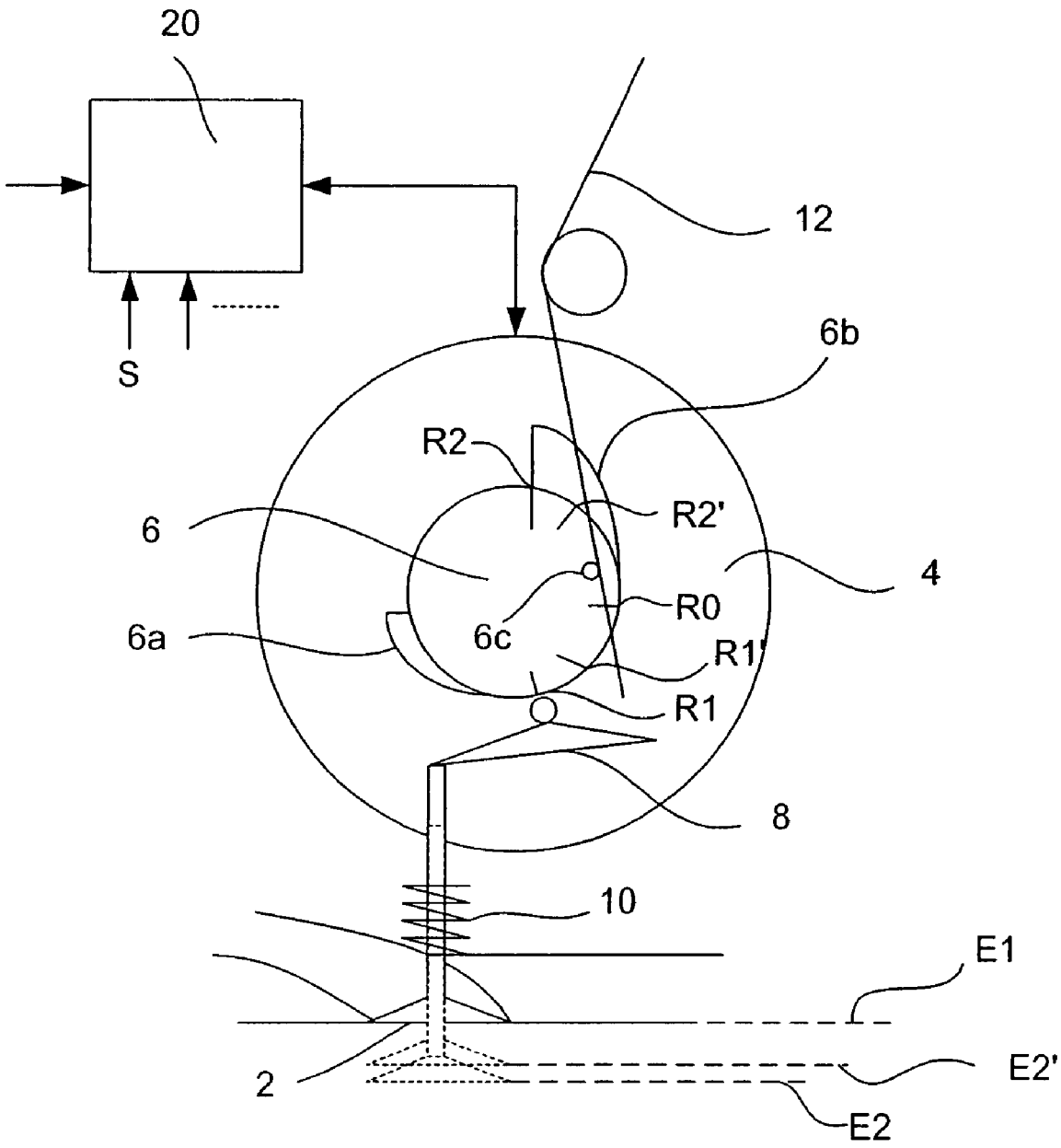
FIG. 1 shows a schematic diagram of a rotary actuator device for the drive for a charge cycle valve of an internal combustion engine (not shown)

FIG. 1 shows a schematic diagram of a rotary actuator device for the drive for an exhaust charge cycle valve 2 (hereinafter referred to as a charge cycle valve) of an internal combustion engine (not shown). The essential components of this device include an electric motor 4 (drive mechanism), designed as a servo motor in particular, a camshaft 6 (actuating element) having preferably two cams 6*a*, 6*b* of different lifts driven by the electric motor, a rocker lever 8 (transfer element) operatively connected to the camshaft 6 on the one hand and to the charge cycle valve 2 on the other hand, for transmitting the movement of the lift height, which is predetermined by the cams 6*a*, 6*b*, to the charge cycle valve 2 and a first energy storage means 10, which is designed as a closing spring and acts upon the charge cycle valve 2 with a spring force in the closing direction and a second energy storage means 12 that is designed as an opening spring and acts upon the charge cycle valve 2 with an opening force via the camshaft 6 and the rocker lever 8. For the precise functioning and mechanical design of the rotary actuator device, reference is made to DE 102 52 991 A1.

To ensure low power consumption in operation of electric motor 4, which drives the charge cycle valve 2 via the camshaft 6, the electric motor 4 is regulated via a regulating device 20 according to a setpoint path which represents the ideal transient characteristic of the spring-mass-spring system in addition to the optimal design of the mutually counteracting springs (closing spring 10, opening spring 12) and the ideal positioning of the fulcrums and hinge connection points in the geometry of the device itself. In particular, this regulation is accomplished by regulating the rotor characteristic of the electric motor 4 which drives the at least one actuator element 6, 6*a*, 6*b*. The ideal displacement characteristic of the rotor, which also oscillates as part of the oscillating system, is determined by calculation by analogy with the ideal oscillation characteristic of the overall system and forms the setpoint path for regulating the electric motor 4. For monitoring the actual position of the rotor, a distance sensor (not shown) is provided, transmitting a sensor signal S to the regulating device 20 or another control device. The electric motor 4 is controlled by the regulating device 20 in such a way that the at least one charge cycle valve 2 is transferred from a first valve end position E1, which corresponds to the closed valve position, for example, into a second valve end position E2, E2', which corresponds to a partially opened valve position (E2': partial lift) or a maximally opened valve position (E2: full lift), for example, and vice versa. In regulation of the electric motor 4, the rotor and thus the actuator element 6, 6*a*, 6*b* that is operatively connected to the rotor are controlled in their positions accordingly so that the rotor and/or the actuator element 6, 6*a*, 6*b* will assume a position in the distance range of the cam base circle, e.g., in the distance range between R1 and R1' by analogy with the closed position E1 of the charge cycle valve 2, and will assume a position in the distance range of the cam 6*a*, 6*b*, e.g., in the distance range between R2 and R2' by analogy with the second end position E2, E2'. This system is ideally designed so that the actuating element 6, 6*a*, 6*b* travels the path between the two end positions R1-R2 (full lift) or R1'-R2' (partial lift) without any input of additional energy, i.e., without being actively driven by the drive unit 4 in exclusion of (deliberately not taking into account) ambient influences (in particular friction and gas backpressure), and thus intervenes in a supportive manner only in the case of ambient influences that occur in practice. The system is preferably designed so that in the maximum end positions R1, R2 of the rotor (oscillation end positions at maximal oscillation stroke) it is in a torque-neutral position in which the resulting forces are in a force equilibrium and in which the rotor is held without applying any additional holding force.

In particular, the charge cycle valve 2 is closed in the first torque-neutral position R1 (shown in FIG. 1) and thus the closing spring 10 is maximally relaxed while retaining a residual prestress, while the opening spring 12 is maximally prestressed. The force of the prestressed opening spring 12 is transferred to the camshaft 6 via a stationary supporting element 6*c* thereof and is aligned precisely through the midpoint of the camshaft 6 in position R1 and is thus more or less neutralized. The force of the closing spring 10 which is due to the residual prestress is also neutralized in the position described because it is also directed into the midpoint of the camshaft 6 via the rocker lever 8.

In the second torque-neutral position R2 (not shown here), the charge cycle valve 2 would be opened with its maximal lift according to the main cam 6*b* and the closing spring 10 arranged around the charge cycle valve 2 would be maximally prestressed while the opening spring 12 would be maximally relaxed while retaining a residual prestress. The arrangement of the individual components is selected so that the force of the maximally prestressed spring means (now: closing spring 10) and the maximally relaxed spring means (now: opening spring 12) would each be directed exactly through the midpoint of the camshaft 6 and would thus be more or less neutralized in this position.

A third torque-neutral position R0, also not shown, prevails when the system assumes a so-called fallen state in which the camshaft 6 assumes a position between the two first torque-neutral positions R1, R2. The system can be brought back out of the fallen position only by means of a high energy expenditure, e.g., by moving the camshaft 6 back into one of the first two torque-neutral positions R1, R2 by ramping up the rotor or the camshaft 6 is ramped up at least to a partial lift at which regular operation of the rotor actuator device is possible again.

By analogy with the three torque-neutral positions R0, R1, R2 described here for operation of the device by means of the main cam 6*b*, additional positions (not shown) may be provided for minimal lift operation in actuation of the second cam 6*a*. For these additional torque-neutral positions, the statements made above for the torque-neutral positions R0, R1 and R2 are also applicable here.

With the ideal transient characteristic calculated here, the rotor then oscillates from one end position E1, E1' into the other end position E2, E2' merely on the basis of the forces stored in the energy storage means 10, 12 without any input of additional energy, e.g., by the electric motor 4.

In the case when the rotor oscillates in partial lift range from a first end position R1' to a corresponding second end position R2' (in particular at high rotational speeds of the internal combustion engine) the ideal transient characteristic would thus be that of a perpetual motion machine (infinite uniform oscillation).

For the case when the rotor oscillates from a first end position R1 to a corresponding second end position R2 in full lift range (in particular at low rotational speeds of the internal combustion engine), it would be held in a torque-neutral position in each of the end positions R1, R2 and would have to be prompted to execute the next oscillation out of this position into the other end position again by applying a thrust energy (engine thrust).

Due to the fact that the setpoint paths for full lift and partial lift correspond to the transient characteristic of the rotary actuator device without friction losses and without gas backpressures, this ensures that the regulating device 20 will control the electric motor 4 exclusively for equalizing the frictional losses and the resulting gas backpressures that always prevail in practice. Since frictional losses occur mainly at high rotor rotational speeds, the electric motor 4 must deliver the highest power at high rotational speeds. Since this coincides with the energy-optimal operating point of electric motor 4, an energy-saving operation of the actuator system can be ensured by regulating it on the basis of idealized setpoint paths of the actuator system to be operated.

Figures 2A, 2B:
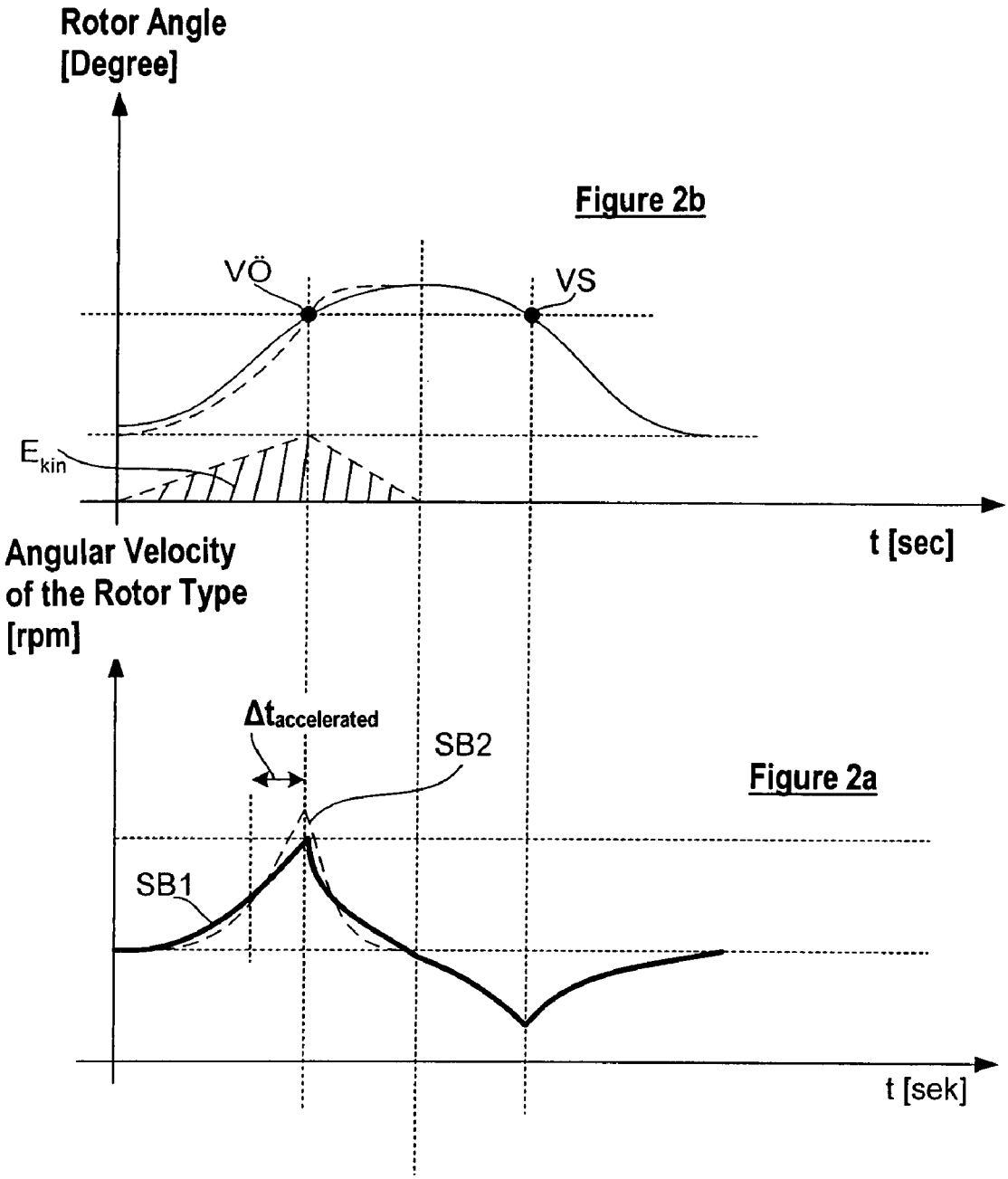
FIGS. 2*a*, 2*b* show the setpoint specification of a speed characteristic of the rotary of an electric motor for actuation of an exhaust charge cycle valve and the corresponding resulting rotor angle.

FIG. 2*a* shows schematically the setpoint specification of a speed characteristic for the rotor of an electric motor 4 for actuation of an exhaust charge cycle valve 2. The setpoint path SB1 shown in bold is a setpoint path for regulating the rotor speed on the basis of which it should be regulated when only lower gas backpressures are prevailing or are to be expected inside the combustion chamber during the opening process of the exhaust charge cycle valve 2. The second setpoint path SB2 which is not shown in bold is a setpoint path for the case when elevated gas backpressures are prevailing or are to be expected in the combustion chamber so that this setpoint path simulates an increased speed specification for the rotor, in particular in the distance range shortly before the start of the actual valve opening movement of the exhaust charge cycle valve 2. The rotor speed is increased such that an elevated kinetic energy $E_{kin_accelerated}$ is generated by means of the second setpoint path SB2 and can be transferred to the exhaust charge cycle valve 2. To this end the speed specification may be increased on the basis of the second setpoint path SB2 either over the entire distance range of the rotor and at any point in time—in comparison with the first setpoint path—or it should be increased over only individual portions of the distance range. In particular in a defined period of time $\Delta t_{accelerated}$ before the start of the valve opening movement (at point VO) the rotor speed is increased in a controlled manner. The period of time $\Delta t_{accelerated}$ as well as the height of the acceleration are preferably predetermined as a function of the respective prevailing load requirement. To maintain predetermined control times, the speed of the rotor in the startup phase of the rotor is thus lower accordingly in the setpoint path for a lower or average load demand. It is essential to this invention only that the increase in speed results in an increase in the kinetic energy which ensures that gas backpressures occurring at any point in time during operation can be overcome in the opening process of the exhaust charge cycle valve 2. A plurality of setpoint paths is preferably available for regulating the rotor speed, a predetermined load range and/or a predetermined gas backpressure range being allocated to each setpoint path. Furthermore, additional setpoint paths may be generated by interpolation in a range between two neighboring stored setpoint paths.

FIG. 2*b* shows the rotor angle of the electric motor 4 established on the basis of the regulation of the angular velocity of the rotor. The section of curve shown with a dotted line is the angular characteristic of the rotor on the basis of the increased angular velocity of the rotor. Similarly, the increased angular velocity of the rotor thus leads directly to an increased rotor angle. The prematurely increased rotor angle does not lead to direct output of the charge cycle valve 2 because of the free-running section described above but instead makes it possible to build up an additional kinetic energy $E_{kin_accelerated}$ in the inventive manner (by acceleration of the masses moving during free-running, e.g., the rotor mass and the mass of the actuator element) to support the electric motor 4 during the opening process of the exhaust charge cycle valve 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for regulating a lift characteristic of an exhaust charge cycle valve of an internal combustion engine, comprising:

a controllable electric motor having an actuator element for actuating the exhaust charge cycle valve;

a regulating device for controlling the electric motor; and two energy storage units acting in opposite drive directions on the exhaust charge cycle valve, wherein the regulating device controls the electric motor according to at least one stored setpoint path, the at least one setpoint path defining actuation of the actuator element such that the exhaust charge cycle valve is transferred between a first end position and a second end position by swiveling a rotor of the electric motor, and the at least one stored setpoint path includes at least two different setpoint paths provided for regulating the speed of the rotor of the electric motor, whereby a lower kinetic energy is transferred to the exhaust charge cycle valve under one of the at least two different setpoint paths during a valve opening process than under another of the at least two different setpoint paths.

2. The device as claimed in claim 1, wherein the at least two different setpoint paths are associated with an equal number of different engine load demand ranges.

3. The device as claimed claim 1, wherein the regulating device or another control unit is programmed to generate at least one setpoint path between two stored setpoint paths.

4. A method for regulating a lift characteristic of an exhaust charge cycle valve of an internal combustion engine, comprising the steps of:

controlling a rotor of an electric motor which drives the exhaust charge cycle valve according to a stored setpoint path as a setpoint specification for the rotor speed, wherein at least two setpoint paths are provided for regulating a speed of the rotor of the electric motor, such that a lower rotor maximal speed is established in accordance with a first one of the two setpoint paths than is established in accordance with a second one of the setpoint paths.

* * * * *